US006601407B1

(12) United States Patent
Deniz et al.

(10) Patent No.: US 6,601,407 B1
(45) Date of Patent: Aug. 5, 2003

(54) CRYOGENIC AIR SEPARATION WITH TWO PHASE FEED AIR TURBOEXPANSION

(75) Inventors: Sabri Deniz, Grand Island, NY (US); Gregory William Henzler, East Amherst, NY (US); Dante Patrick Bonaquist, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/301,705

(22) Filed: Nov. 22, 2002

(51) Int. Cl.[7] ..... F25J 3/04
(52) U.S. Cl. ..... 62/646
(58) Field of Search ..... 62/617, 640, 643, 62/646

(56) References Cited

U.S. PATENT DOCUMENTS 5,564,290 A 10/1996 Bonaquist et al. ..... 62/646
5,682,766 A * 11/1997 Bonaquist et al. ..... 62/646
5,758,515 A 6/1998 Howard ..... 62/646
5,802,873 A 9/1998 Howard ..... 62/646
5,832,748 A * 11/1998 Bonaquist ..... 62/647
5,934,105 A 8/1999 Bonaquist et al. ..... 62/646
6,000,239 A 12/1999 Bonaquist et al. ..... 62/646
6,053,008 A 4/2000 Arman et al. ..... 62/646
6,112,550 A 9/2000 Bonaquist et al. ..... 62/646
6,397,632 B1 6/2002 Meagher ..... 62/648

* cited by examiner

*Primary Examiner*—Denise L. Esquivel
*Assistant Examiner*—Malik N. Drake
(74) *Attorney, Agent, or Firm*—Stanley Ktorides

(57) ABSTRACT

A method for cryogenic air separation wherein at least a portion of the feed air to the cryogenic air separation plant is partially condensed and the resulting two-phase feed air stream is turboexpanded to produce refrigeration and a resulting two-phase feed air stream, which has a liquid portion less than that of the input two-phase feed air stream to the turboexpander, prior to being passed into the cryogenic air separation plant.

8 Claims, 1 Drawing Sheet

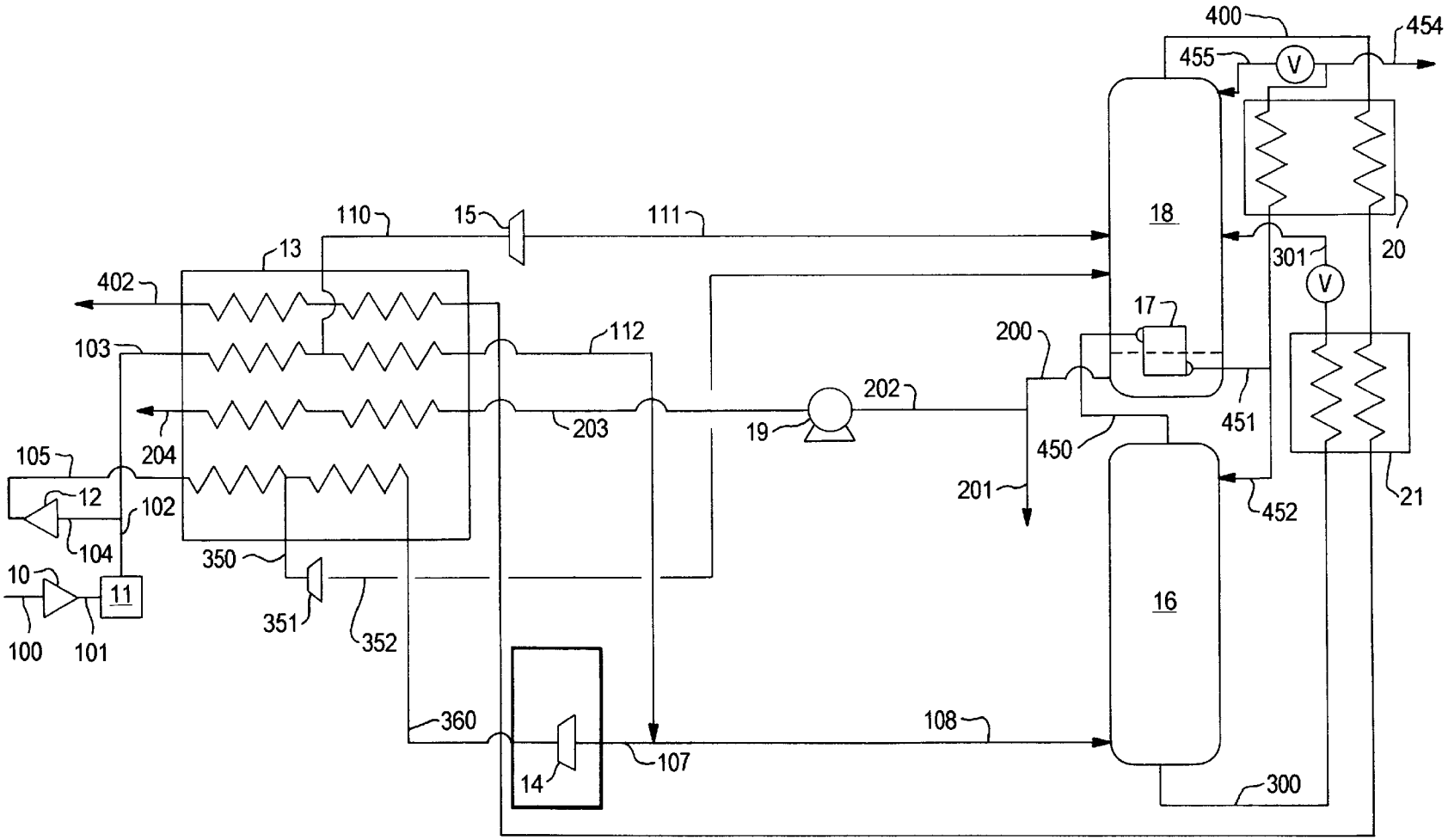
454
20
21
400
455
301
452
451
300
18
17
16
450
200
201
108
202
19
111
112
203
107
14
15
360
110
352
13
351
350
402
204
102
103
11
12
104
101
105
10
100

CRYOGENIC AIR SEPARATION WITH TWO PHASE FEED AIR TURBOEXPANSION

TECHNICAL FIELD

This invention relates generally to cryogenic air separation and, more particularly, to the provision of refrigeration for the cryogenic air separation by the turboexpansion of feed air.

BACKGROUND ART

One important aspect in the cryogenic rectification of feed air to produce one or more products such as oxygen and nitrogen, is the provision of refrigeration to the process to drive the rectification. One method for providing such refrigeration is the turboexpansion of a compressed gaseous process stream to generate refrigeration which is then provided into the cryogenic air separation plant. Often the turboexpanded process stream is a feed air stream and the refrigeration is passed into the cryogenic air separation plant for the rectification with the turboexpanded feed air.

The turboexpansion of feed air to generate refrigeration for cryogenic air separation is energy intensive. Any improvement to such turboexpansion operation would be highly desirable.

Accordingly, it is an object of this invention to provide an improved method for carrying out cryogenic air separation wherein refrigeration is provided by the turboexpansion of a feed air stream with reduced power requirements over conventional systems.

SUMMARY OF THE INVENTION

The above and other objects, which will become apparent to those skilled in the art upon a reading of this disclosure, are attained by the present invention which is:

A method for producing at least one product by the cryogenic rectification of feed air comprising:

(A) partially condensing a flow of feed air to produce a first two-phase flow of feed air having a liquid phase portion which is not more than 99 percent of said first two-phase flow of feed air;

(B) passing said first two-phase flow of feed air to a turboexpander, and turboexpanding the said first two-phase flow of feed air in the turboexpander to produce a second two-phase flow of feed air having a liquid phase portion which is less than the liquid phase portion of the first two-phase flow of feed air;

(C) passing the second two-phase flow of feed air to a cryogenic air separation plant comprising at least one column; and (D) separating the feed air by cryogenic rectification in the cryogenic air separation plant to produce at least one product.

As used herein, the term "two-phase flow" means a fluid having both a liquid phase and a vapor phase.

As used herein, the terms "turboexpansion" and "turboexpander" mean respectively method and apparatus for the flow of high pressure fluid through a turbine to reduce the pressure and the temperature of the fluid thereby generating refrigeration.

As used herein, the term "column" means a distillation or fractionation column or zone, i.e. a contacting column or zone wherein liquid and vapor phases are countercurrently contacted to effect separation of a fluid mixture, as for example, by contacting the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process*. The term, double column, is used to mean a higher pressure column having its upper end in heat exchange relation with the lower end of a lower pressure column. A further discussion of double columns appears in Ruheman "The Separation of Gases", Oxford University Press 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the more volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin (K).

As used herein, the term "indirect heat exchange" means the bringing of two fluid streams into heat exchange relation without any physical contact or intermixing of the fluids with each other.

As used herein, the term "cryogenic air separation plant" means the column or columns wherein feed air is separated by cryogenic rectification, as well as interconnecting piping, valves, heat exchangers and the like.

As used herein, the terms "upper portion" and "lower portion" of a column means those portions respectively above and below the midpoint of the column.

As used herein, the term "product oxygen" means a fluid having an oxygen concentration equal to or greater than 80 mole percent.

As used herein, the term "product nitrogen" means a fluid having a nitrogen concentration equal to or greater than 97 mole percent.

As used herein, the term "feed air" means a mixture comprising primarily nitrogen and oxygen, such as ambient air.

BRIEF DESCRIPTION OF THE DRAWING

The sole FIGURE is a schematic representation of one preferred embodiment of the invention.

DETAILED DESCRIPTION

The invention comprises the turboexpansion of high pressure partially condensed feed air. The feed air is partially condensed to vaporize pumped liquid oxygen. The turboexpansion increases the vapor portion of the feed air and the production of refrigeration and work by the turboexpander is greatly increased when the phase change occurs within the turboexpander.

The invention will be described in detail with reference to the Drawing. Referring now to the FIGURE, feed air 100 is compressed in compressor 10 to a pressure within the range of from 60 to 100 pounds per square inch absolute (psia) and resulting feed air 101 is cleaned of high boiling impurities, such as carbon dioxide, water vapor and hydrocarbons in purifier 11. Cleaned, compressed feed air 102 is divided into a first portion 103, comprising from 50 to 80 percent of feed air 100, and into second portion 104 comprising from 20 to 50 percent of feed air 100. Stream 103 is cooled by passage through main heat exchanger 13 against return streams and resulting cooled stream 112 is passed into the cryogenic rectification plant. In the embodiment illustrated in the FIGURE, the cryogenic rectification plant comprises a double column having a higher pressure column 16, operating at a pressure within the range of from 55 to 95 psia, and lower pressure column 18, operating at a pressure less than that of higher pressure column 16 and within the range of from 15 to 25 psia. In the embodiment illustrated in the FIGURE, stream 112 is combined with the discharge from two phase turboexpander 14 and the combined stream 108 is passed into higher pressure column 16. If desired, a portion 110 of gaseous stream 103 may be withdrawn prior to complete traverse of main heat exchanger 13, turboexpanded through turboexpander 15 to produce turboexpanded gaseous stream 111, and passed into lower pressure column 18.

In the embodiment illustrated in the FIGURE, at least a portion of stream 104 is used to vaporize the pressurized liquid oxygen. Stream 104 is compressed through compressor 12 to a pressure within the range of from 80 to 1400 psia and resulting high pressure feed air stream 105 is passed into main heat exchanger or product boiler 13 wherein it is cooled by indirect heat exchange with return streams. The embodiment of the invention illustrated in the FIGURE is a preferred embodiment wherein a portion 350 of the high pressure gaseous feed air 105 is withdrawn from main heat exchanger 13 and turboexpanded by passage through turboexpander 351 to generate refrigeration. Resulting gaseous feed air stream 352 is passed from turboexpander 351 into lower pressure column 18.

The remaining portion of the high pressure gaseous feed air 105, or all of feed air stream 105 if the turboexpansion of portion 350 is not employed, is partially condensed by further passage through main heat exchanger 13 by indirect heat exchange with vaporizing liquid oxygen and is withdrawn from main heat exchanger 13 at the end or close to the end of heat exchanger 13, as two phase stream 360. The liquid phase portion of feed air stream 360 is not more than 99 percent, preferably not more than 85 percent, of two-phase feed air stream 360. Two-phase feed air stream 360 is then passed to two-phase turboexpander 14 wherein it is turboexpanded, preferably to a pressure within the range of from 55 to 95 psia, to generate refrigeration and to produce second two-phase feed air stream 107 which has a liquid phase portion which is less than the liquid phase portion of first two-phase feed air stream 360. Generally the liquid phase portion of stream 107 comprises from 40 to 90 percent, preferably from 60 to 80 percent, of two-phase stream 107 with the remainder being vapor. Dual phase feed air stream 107 is passed into the lower portion of higher pressure column 16. In the embodiment illustrated in the FIGURE, dual phase feed air stream 107 is combined with gaseous feed air stream 112 to form combined stream 108 which is passed into column 16.

The two phase turbine inlet flow of this invention provides a significant increase in refrigeration over conventional single phase turbine inlet flow systems. The constraint imposed by the mechanical equipment on the turbine inlet condition is eliminated. The invention removes the limitation of a single phase fluid at the exit of the product boiling heat exchanger. The two phase inlet flow conditions to the turboexpander enable an improved thermodynamic efficiency by applying the turbine at a lower temperature level.

Within higher pressure column 16 the feed air is separate by cryogenic rectification into nitrogen-enriched vapor and oxygen-enriched liquid. Nitrogen-enriched vapor is withdrawn from the upper portion of column 16 as stream 450 and condensed in main condenser 17 against column 18 bottom liquid. Resulting liquid nitrogen 451 is divided into portion 452, which is passed into the upper portion of column 16 as reflux, and into portion 455, which is passed through heat exchanger 20 and into the upper portion of column 18 as reflux. If desired, a portion 454 of the liquid nitrogen may be recovered as product.

Oxygen-enriched liquid is withdrawn from the lower portion of column 16 as stream 300, and passed through heat exchanger 21 with resulting stream 301 passed into lower pressure column 18.

Within lower pressure column 18 the various feeds are separated by cryogenic rectification into gaseous nitrogen and liquid oxygen. Gaseous nitrogen is withdrawn from the upper portion of column 18 as stream 400, warmed by passage through heat exchangers 20, 21 and 13 and removed from the system as stream 402, which may be recovered, in whole or in part, as product nitrogen.

Liquid oxygen is withdrawn from the lower portion of lower pressure column 18 as stream 200. If desired, a portion of the liquid oxygen may be recovered as product oxygen in stream 201. Resulting liquid oxygen stream 202 is passed through liquid pump 19 wherein it is increased in pressure to a pressure within the range of from 25 to 1400 psia. Resulting elevated pressure liquid oxygen 203 is vaporized by passage through product boiler or main heat exchanger 13 by indirect heat exchange with the aforedescribed partially condensing high pressure feed air. Resulting elevated pressure gaseous oxygen is recovered as product oxygen in stream 204.

Although the invention has been described in detail with reference to a certain preferred embodiment, those skilled in the art will recognize that there are other embodiments of the invention within the spirit and the scope of the claims.

What is claimed is:

1. A method for producing at least one product by the cryogenic rectification of feed air comprising:

(A) partially condensing a flow of feed air to produce a first two-phase flow of feed air having a liquid phase portion which is not more than 99 percent of said first two-phase flow of feed air;

(B) passing said first two-phase flow of feed air to a turboexpander, and turboexpanding the said first two-phase flow of feed air in the turboexpander to produce a second two-phase flow of feed air having a liquid phase portion which is less than the liquid phase portion of the first two-phase flow of feed air;

(C) passing the second two-phase flow of feed air to a cryogenic air separation plant comprising at least one column; and (D) separating the feed air by cryogenic rectification in the cryogenic air separation plant to produce at least one product.

2. The method of claim 1 wherein the liquid phase portion of the second two-phase flow of feed air comprises from 40 to 90 percent of the second two-phase flow of feed air.

3. The method of claim 1 wherein the partially condensing flow of feed air is at a high pressure and further comprising passing a gaseous feed air stream having a pressure less than that of the high pressure condensing flow of feed air into the cryogenic air separation plant.

4. The method of claim 1 wherein the partially condensing flow of feed air is at a high pressure and further comprising turboexpanding a gaseous feed air stream having a pressure less than that of the high pressure condensing flow of feed air, and passing the resulting turboexpanded gaseous feed air stream into the cryogenic air separation plant.

5. The method of claim 1 wherein the partially condensing flow of feed air is at a high pressure and further comprising turboexpanding a gaseous feed air stream having a pressure about equal to that of the high pressure condensing flow of feed air, and passing the resulting turboexpanded gaseous feed air stream into the cryogenic air separation plant.

6. The method of claim 1 wherein the flow of feed air is partially condensed by indirect heat exchange with vaporizing liquid oxygen taken from the cryogenic air separation plant.

7. The method of claim 1 wherein the first two-phase flow of feed air has a liquid portion which is not more than 85 percent of said first two-phase flow of feed air.

8. The method of claim 1 wherein the liquid phase portion of the second two-phase flow of feed air comprises from 60 to 80 percent of the second two-phase flow of feed air.

* * * * *